US005566700A

United States Patent [19]

Brown

[11] Patent Number: 5,566,700

[45] Date of Patent: Oct. 22, 1996

[54] WALKING STICK

[76] Inventor: Roger C. Brown, 13 Townholm Cresent, Hanwell, London, England, W72LY

[21] Appl. No.: 567,114

[22] Filed: Dec. 4, 1995

[51] Int. Cl.[6] ..... A61H 3/02

[52] U.S. Cl. ..... 135/72; 135/84

[58] Field of Search ..... 135/65, 66, 72, 135/76, 84, 85; 446/70, 472

[56] References Cited

U.S. PATENT DOCUMENTS

| | | | |
|---|---|---|---|
| D. 290,186 | 6/1987 | Meunchen . | |
| 869,128 | 10/1907 | Autenreith | 135/72 |
| 1,621,255 | 3/1927 | Hunter | 135/84 X |
| 4,044,784 | 8/1977 | Smith . | |
| 4,258,735 | 3/1981 | Meade . | |
| 4,596,405 | 6/1986 | Jones | 135/75 X |
| 4,899,771 | 2/1990 | Wilkinson | 135/84 X |
| 4,958,651 | 9/1990 | Najm | 135/85 X |
| 5,287,870 | 2/1994 | Rhodes | 135/72 |
| 5,301,704 | 4/1994 | Brown . | |
| 5,385,163 | 1/1995 | Fairchild . | |

FOREIGN PATENT DOCUMENTS

| | | | |
|---|---|---|---|
| 8201315 | 4/1982 | WIPO | 135/84 |

*Primary Examiner*—Lanna Mai

[57] ABSTRACT

A walking stick for aiding support of a walking individual. The inventive device includes a stanchion assembly having a handgrip assembly secured to an upper end thereof. A ground engaging assembly is secured to a lower end of the stanchion assembly for rollingly engaging a ground surface during walking and for supporting the walking stick in an upright orientation during periods of non-use thereof.

8 Claims, 3 Drawing Sheets

WALKING STICK

BACKGROUND OF THE INVENTION

1. Field of the Invention

The present invention relates to walking canes and more particularly pertains to a walking stick for aiding support of a walking individual.

2. Description of the Prior Art

The use of walking canes is known in the prior art. More specifically, walking canes heretofore devised and utilized are known to consist basically of familiar, expected and obvious structural configurations, notwithstanding the myriad of designs encompassed by the crowded prior art which have been developed for the fulfillment of countless objectives and requirements.

Known prior art walking canes include U.S. Pat. No. 5,301,704; U.S. Pat. No. 4,899,771; U.S. Pat. No. 4,044,784; U.S. Pat. No. 4,258,735; U.S. Pat. No. 5,385,163; and U.S. Pat. No. Design 290,186.

While these devices fulfill their respective, particular objectives and requirements, the aforementioned patents do not disclose a walking stick for aiding support of a walking individual which includes a stanchion assembly having a handgrip assembly secured to an upper end thereof, and a ground engaging assembly secured to a lower end of the stanchion assembly for rollingly engaging a ground surface during walking and for supporting the walking stick in an upright orientation during periods of non-use thereof.

In these respects, the walking stick according to the present invention substantially departs from the conventional concepts and designs of the prior art, and in so doing provides an apparatus primarily developed for the purpose of aiding support of a walking individual.

SUMMARY OF THE INVENTION

In view of the foregoing disadvantages inherent in the known types of walking canes now present in the prior art, the present invention provides a new walking stick construction wherein the same can be utilized for aiding support of a walking individual. As such, the general purpose of the present invention, which will be described subsequently in greater detail, is to provide a new walking stick apparatus and method which has many of the advantages of the walking canes mentioned heretofore and many novel features that result in a walking stick which is not anticipated, rendered obvious, suggested, or even applied by any of the prior art walking canes, either alone or in any combination thereof.

To attain this, the present invention generally comprises a walking stick for aiding support of a walking individual. The inventive device includes a stanchion assembly having a handgrip assembly secured to an upper end thereof. A ground engaging assembly is secured to a lower end of the stanchion assembly for rollingly engaging a ground surface during walking and for supporting the walking stick in an upright orientation during periods of non-use thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new walking stick apparatus and method which has many of the advantages of the walking canes mentioned heretofore and many novel features that result in a walking stick which is not anticipated, rendered obvious, suggested, or even implied by any of the prior art tool guides, either alone or in any combination thereof.

It is another object of the present invention to provide a new walking stick which may be easily and efficiently manufactured and marketed.

It is a further object of the present invention to provide a new walking stick which is of a durable and reliable construction.

An even further object of the present invention is to provide a new walking stick which is susceptible of a low cost of manufacture with regard to both materials and labor, and which accordingly is then susceptible of low prices of sale to the consuming public, thereby making such walking sticks economically available to the buying public.

Still yet another object of the present invention is to provide a new walking stick which provides in the apparatuses and methods of the prior art some of the advantages thereof, while simultaneously overcoming some of the disadvantages normally associated therewith.

Still another object of the present .invention is to provide a new walking stick for aiding support of a walking individual.

Yet another object of the present invention is to provide a new walking stick which includes a stanchion assembly having a handgrip assembly secured to an upper end thereof, and a ground engaging assembly secured to a lower end of the stanchion assembly for rollingly engaging a ground surface during walking and for supporting the walking stick in an upright orientation during periods of non-use thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
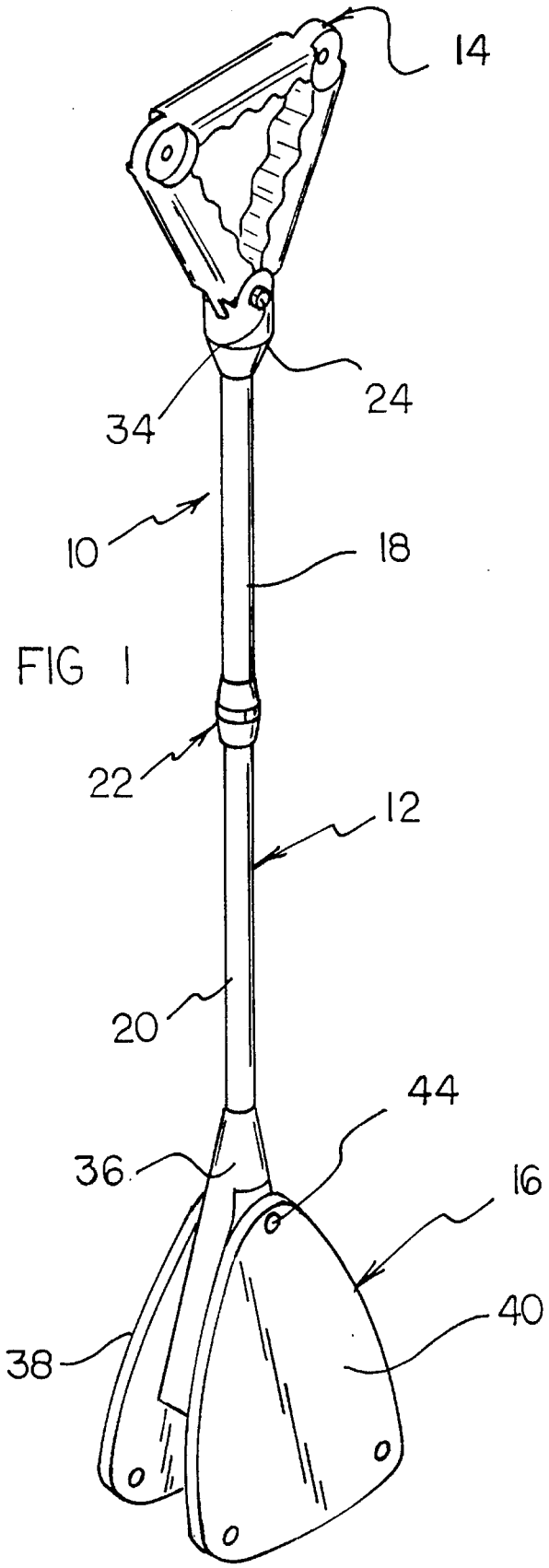
FIG. 1 is an isometric illustration of a walking stick according to the present invention.

With reference now to the drawings, and in particular to FIGS. 1–5 thereof, a new walking stick embodying the principles and concepts of the present invention and generally designated by the reference numeral 10 will be described.

More specifically, it will be noted that the walking stick 10 comprises a stanchion assembly 12 having a handgrip assembly 14 secured to an upper end thereof for permitting manual manipulation of the invention 10 during use thereof. A ground engaging assembly 16 is secured to a lower end of the stanchion assembly 12 for engaging a ground surface during use of the device 10 to aid in supporting a walking individual and to support the invention 10 in an upright orientation during periods of non-use thereof. By this structure, an individual can utilize the invention 10 for stability and guidance when walking and can leave the invention in an upright orientation for future use without having to bend over to retrieve the device from the ground.

As best illustrated in FIGS. 1 through 4, it can be shown that the stanchion assembly 12 of the present invention 10 preferably comprises an upper tube 18 and a lower tube 20 which are telescopingly and slidably interrelated. A coupler 22 is interposed between the upper tube 18 and the lower tube 20 and operates to adjustably secure the tubes together at a desired longitudinal length of the stanchion assembly 12 to permit for adjusting of an overall height of the device 10. The coupler 22 includes a compression ring 23 which can be axially compressed between two threaded members (not labeled) which are secured to the tubes 18 and 20 to create a frictional engagement between the tubes to retain the same in a desired longitudinal orientation.

Figure 2:
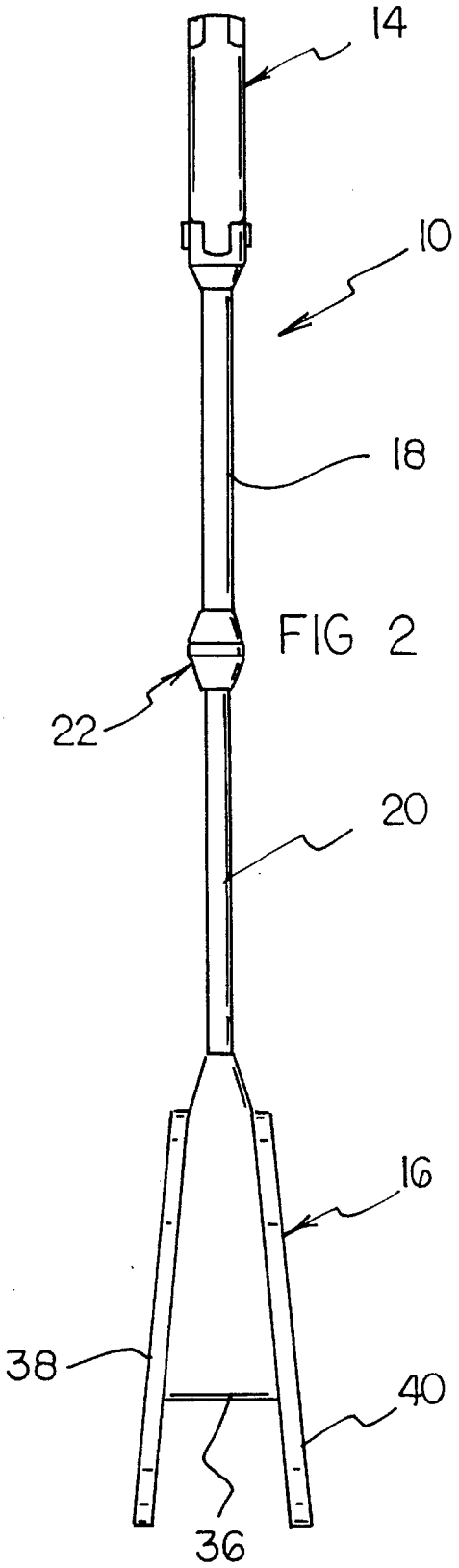
FIG. 2 is a side elelevational view of the walking stick.
Figure 3:
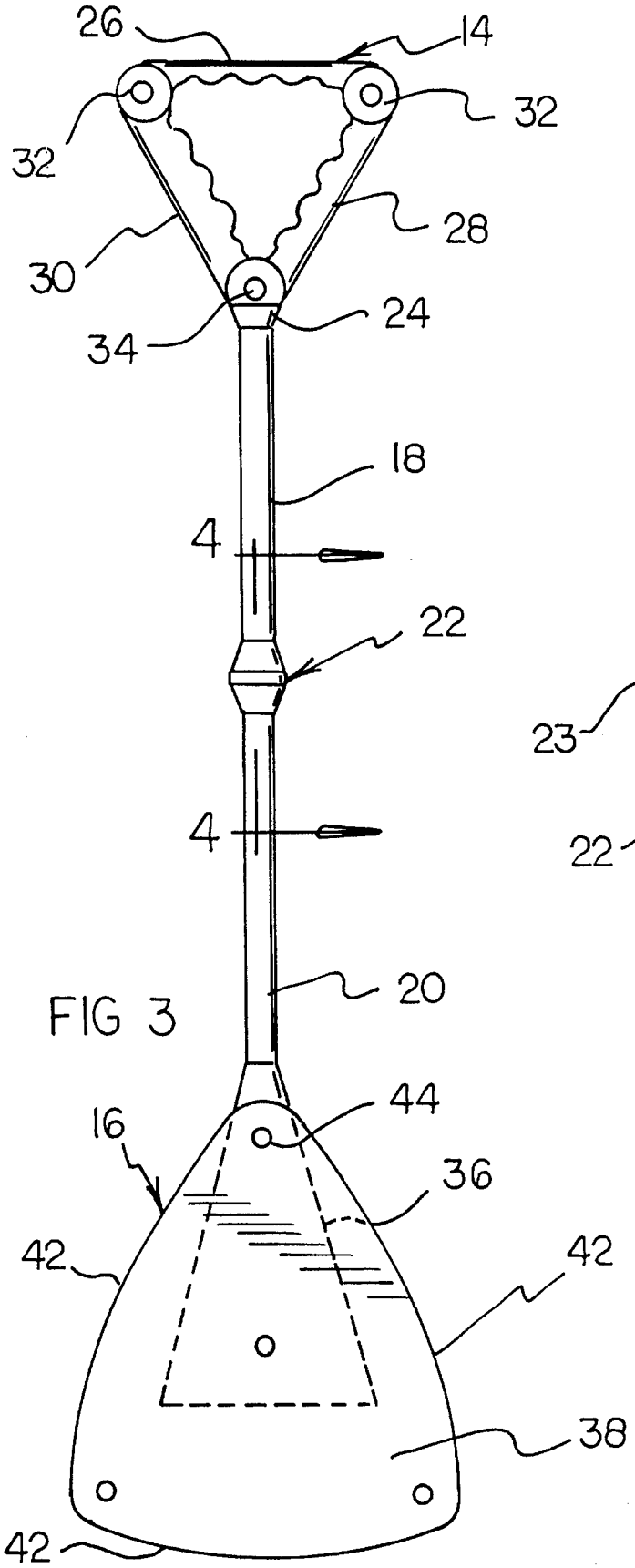
FIG. 3 is a front elevational view thereof.
Figure 4:
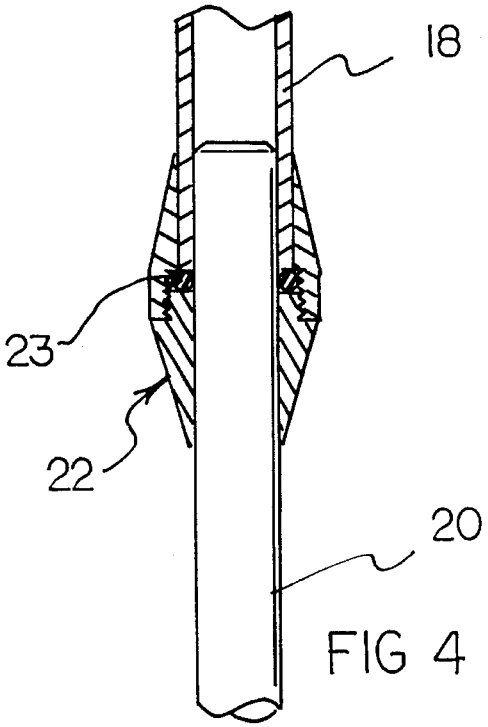
FIG. 4 is a cross sectional view taken along line 4—4 of FIG. 3.
Figure 5:
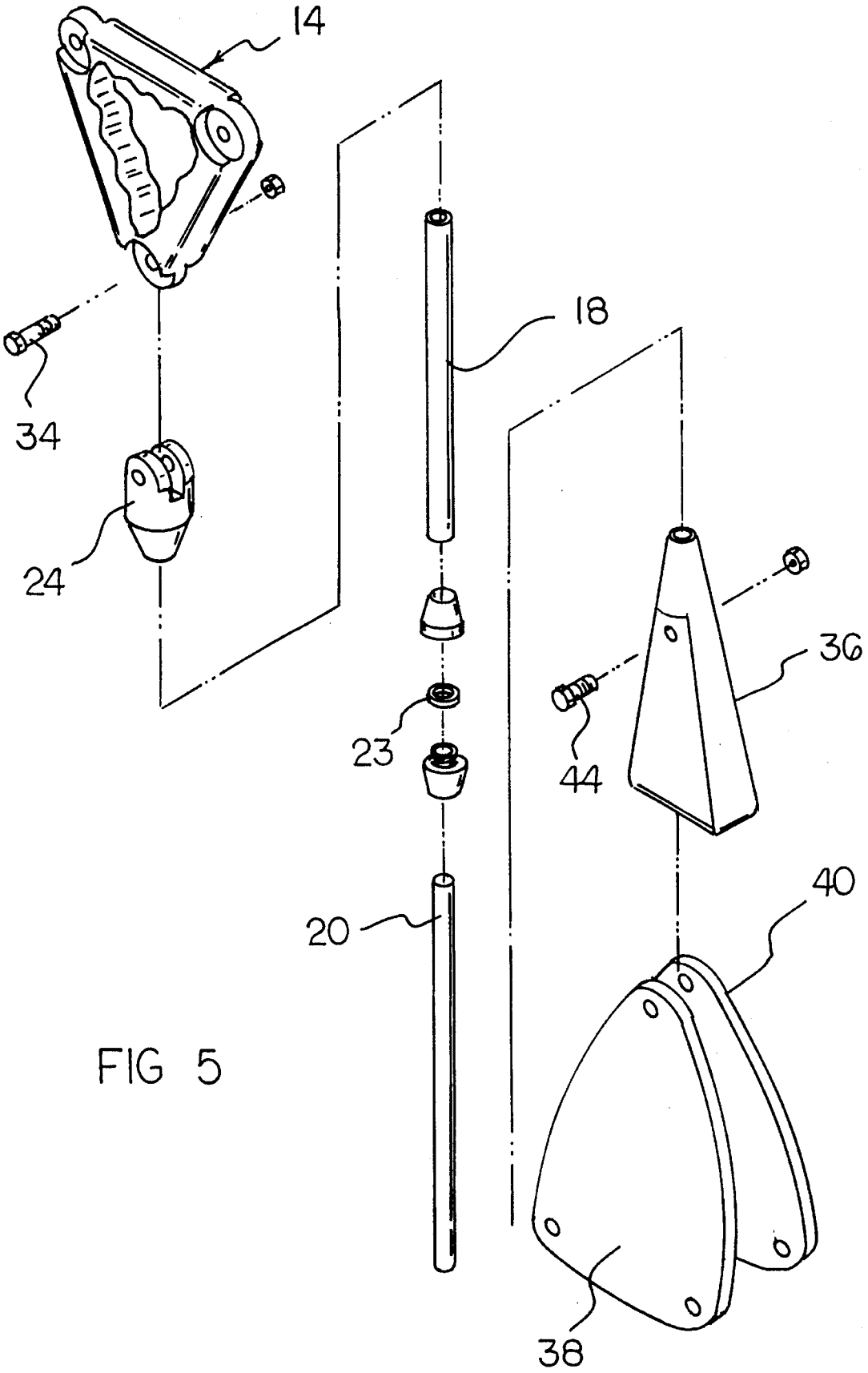
FIG. 5 is an exploded isometric illustration of the invention.

As shown in FIGS. 1 through 3, the handgrip assembly 14 preferably comprises a mounting neck 24 secured to the upper end of the stanchion assembly 12. A plurality of disparate handgrips are connected together at ends thereof to form a polygonal shape and can be secured to the mounting neck in a variety of orientations to permit for use of a desired one of the handgrips. To this end, the handgrip assembly 14 includes a first handgrip 26 coupled at a first end thereof to a first end of a second handgrip 28, as shown in FIG. 3. The second handgrip 28 is coupled at a second end thereof to a first end of a third handgrip 30, with the first handgrip 26 being coupled at a second end thereof to a second end of the third handgrip 30. The handgrips 26–30 are cooperatively shaped so as to define pivotal mounting recesses 32 at intersecting ends thereof which can be individually received and secured by an adjustable neck fastener 34 within the mounting neck 24. The pivotal mounting recesses 32 can be shaped so as to allow pivoting movement of the handgrip assembly 14 relative to the stanchion assembly 12 when the adjustable neck fastener 34 is loosely secured, or alternatively can be shaped so as to preclude pivoting of the handgrip assembly 14 relative to the stanchion assembly 12.

The handgrips 26–30 are preferably disparately shaped relative to one another so as to be selectable as desired for use. To this end, the first handgrip 26 is of a first thickness, and the second handgrip 28 is of a second thickness, wherein the second thickness is substantially greater than the first thickness. Similarly, the third handgrip 30 is of a third thickness, wherein the third thickness is substantially greater than the second thickness, as shown in FIG. 3 of the drawings. By this structure, a handgrip 26–30 of the desired thickness can be positioned into an orthogonal orientation relative to the stanchion assembly 12 for use by an individual.

FIGS. 1 through 5 illustrate the ground engaging assembly 16, and it can be seen from these figures that the same comprises a mounting head 36 secured to a lower end of the stanchion assembly 12. First and second plates 38 and 40 are secured to opposed sides of the mounting head 36. Preferably, the mounting head 36 is shaped so as to position the plates 38 and 40 secured to opposed sides thereof at an oblique orientation relative to one another such that upper ends of the plates are positioned a first distance apart and lower ends of the plates are positioned a second distance apart, wherein the second distance is substantially greater than the first distance, as shown in FIG. 2, to impart greater stability to the device 10 during use thereof. As shown in FIG. 3, the plates 38 and 40 are preferably shaped so as to define a plurality of exterior edges 42 which are arcuate in shape to allow the ground engaging assembly 16 to at least partially rollingly engage with a ground surface. The plates 38 and 40 are further shaped so as to define mounting apertures (unlabeled) proximal to intersections of the exterior edges 42 which can each be individually utilized to mount the plates to the mounting head 36. To this end, an adjustable head fastener 44 is directed through an individual one of the mounting apertures in each of the plates 38 and 40 and through a mounting aperture in the mounting head 36. The plates 38 and 40 are positioned such that lowermost edges 42 are aligned, and the head fastener is secured to retain the plates in this orientation. By this structure, the plates 38 and 40 can be individually or collectively rotated so as to position a desired one of the exterior edges 42 thereof for engagement with the ground surface when the plates 38 and 40 wear out of their original shape.

In use, the walking stick 10 according to the present invention can be easily utilized for aiding support of a walking individual. To this end, the walking stick 10 can be grasped and positioned against a ground surface, with the ground engaging assembly 16 permitting pivoting engagement of the device 10 with the ground as an walking individual travels forwardly of the invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A walking stick comprising:

a stanchion assembly comprising an upper tube and a lower tube telescopingly and slidably interrelated; a coupler interposed between said tubes to adjustably secure the tubes together at a desired longitudinal length;

a handgrip assembly secured to an upper end of the stanchion assembly; said handgrip assembly comprising:

a mounting neck secured to the upper end of said stanchion assembly, a plurality of disparate handgrips including a first handgrip, a second handgrip and a third handgrip;

wherein said second handgrip coupled at a first end thereof to a first end of said first handgrip, said third handgrip coupled at a first end to a second end of said second handgrip, and said first handgrip being coupled at a second end to a second end of the third handgrip;

said handgrips are cooperatively shaped to define mounting recesses at connecting ends thereof, with one of said mounting recesses being received and secured within said mounting neck.

2. The walking stick of claim 1, wherein the handgrips are disparately shaped relative to one another.

3. The walking stick of claim 2, wherein the first handgrip is of a first thickness, the second handgrip is of a second thickness and the third handgrip is of a third thickness, with the third thickness being substantially greater than the second thickness and the second thickness being substantially greater than the first thickness.

4. The walking stick of claim 1 wherein the mounting recesses are shaped so as to allow pivoting movement of the handgrip assembly relative to the stanchion assembly.

5. The walking stick of claim 1, wherein the ground engaging assembly comprises a mounting head secured to a lower end of the stanchion assembly; first and second plates secured to opposed sides of the mounting head.

6. The walking stick of claim 5, wherein the mounting head is shaped so as to position the plates secured to opposed sides thereof at an oblique orientation relative to one another such that upper ends of the plates are positioned a first distance apart and lower ends of the plates are positioned a second distance apart, wherein the second distance is substantially greater than the first distance.

7. The walking stick of claim 5, wherein the plates are shaped so as to define a plurality of exterior edges which are arcuate in shape to allow the ground engaging assembly to at least partially rollingly engage with a ground surface.

8. The walking stick of claim 7, wherein the plates are further shaped so as to define mounting apertures proximal to intersections of the exterior edges which can each be individually utilized to mount the plates to the mounting head; and an adjustable head fastener directed through an individual one of the mounting apertures in each of the plates and through a mounting aperture in the mounting head to secure the plates to the mounting head such that lowermost exterior edges thereof are aligned.

* * * * *